US006089351A

United States Patent [19]

Ahl et al.

[11] Patent Number: 6,089,351

[45] **Date of Patent: *Jul. 18, 2000**

[54] LADDER SUPPORTED HOLDING TRAY

[76] Inventors: Frank E. Ahl, P.O. Box 41; Brian E. Ahl, P.O. Box 154, both of Elliston, Mont. 59728

[ * ] Notice: This patent issued on a continued prosecution application filed under 37 CFR 1.53(d), and is subject to the twenty year patent term provisions of 35 U.S.C. 154(a)(2).

[21] Appl. No.: 08/731,442

[22] Filed: Oct. 15, 1996

[51] Int. Cl.[7] ..... E06C 7/14

[52] U.S. Cl. ..... 182/129; 248/210

[58] Field of Search ..... 182/129, 120, 182/121; 248/210, 211, 238; 220/570

[56] References Cited

U.S. PATENT DOCUMENTS

| | | | |
|---|---|---|---|
| 2,308,180 | 1/1943 | Larsen . | |
| 2,473,951 | 6/1949 | Hickey | 182/120 |
| 2,659,917 | 11/1953 | Dram | 248/210 |
| 2,661,858 | 12/1953 | Howell | 220/570 |
| 2,840,291 | 6/1958 | Becker | 182/120 |
| 2,930,442 | 3/1960 | Carter | 182/120 |
| 3,707,242 | 12/1972 | Golden | 248/210 |
| 4,013,251 | 3/1977 | Cleveland | 248/210 |
| 4,424,949 | 1/1984 | Kimmett et al. | 248/238 |
| 4,815,684 | 3/1989 | Kellstadt | 248/210 |
| 4,949,809 | 8/1990 | Levi | 182/172 |
| 5,052,581 | 10/1991 | Christ et al. | 220/570 |
| 5,079,795 | 1/1992 | Schmid | 248/238 |
| 5,191,954 | 3/1993 | Ledford | 182/129 |
| 5,236,161 | 8/1993 | Haven | 248/210 |
| 5,370,263 | 12/1994 | Brown | 220/751 |
| 5,461,752 | 10/1995 | Lemon | 15/257.06 |
| 5,493,751 | 2/1996 | Misiukowiec et al. | 15/257.06 |
| 5,509,169 | 4/1996 | Drucker | 15/257.06 |

*Primary Examiner*—Alvin Chin-Shue
*Attorney, Agent, or Firm*—Jerry Johnson

[57] ABSTRACT

A ladder supported holding tray comprises a tray assembly for releasable attachment to a step of a step ladder, or to adjacent side by side rungs of overlapping sections of an extension ladder. The tray assembly includes a container and first and second supports disposed on the container, with the first and second supports being substantially disposed beneath the container and supporting the container in an elevated position relative to the supports. The tray assembly additionally includes step engagement means. The step engagement means may typically be disposed on the first and second supports and typically comprise a concave upward sloping surface configured to releasably engage and securely hook onto a step from underneath the step. The step engagement means permit secure temporary attachment of the tray to a single step of a step ladder without the tray assembly engaging the side rail members of the ladder or other steps or rungs of the ladder.

12 Claims, 4 Drawing Sheets

LADDER SUPPORTED HOLDING TRAY

BACKGROUND

Ladder supported holding trays suitable for holding hardware or paint have existed in various configurations. These trays typically utilize support members that permit temporary attachment of the tray to a step ladder or an extension ladder. A common problem associated with ladder supported holding trays is that such trays are specifically designed to attach to a single type of ladder. Furthermore, these ladder supported holding trays often only permit attachment to a specific configuration of step ladder or a specific configuration of extension ladder. As many variations of ladders exist in the marketplace there can be difficulty in finding a proper holding tray that the ladder will accommodate.

Another problem associated with typical ladder supported holding trays has been the attachment means utilized to secure the trays to a ladder. These trays typically require attachment either to two steps of a step ladder; to a step of a step ladder and the ladder rail, or to two spaced apart rungs or an extension ladder. Due to the variations in ladder construction, the supporting members of the trays often have to be adjusted when possible to securely attach the tray to a ladder. Where adjustment isn't possible often the tray cannot be utilized with particular ladders.

Existing ladder supported holding trays are often problematic to mount on a ladder because of the necessity to attach at more than one point on the ladder. Additionally, most ladder supported holding trays require the user to hold the tray with one hand, while attaching the tray to the ladder with a second hand. This is particularly difficult when the attachment means includes fasteners. It is both difficult and dangerous to devote both hands to mounting a holding tray to a ladder when the user is standing on the ladder. If the ladder supported holding tray mounts in a manner where the tray is not centered on the ladder but is cantilevered off the ladder and attaches to the ladder rail, the attachment process becomes even more difficult and dangerous. In an arrangement of this type the user must lean away from the ladder while holding the tray while also fastening the tray to the ladder. Ladder supported holding trays of this type are also prone to destabilizing the ladder to which they are attached.

Existing tray designs that utilize a single step for attachment utilize a support on the tray which can be attached to a single rung or step and from which the tray hangs. A problem associated with this design is the lack of stability of a tray that can easily be accidentally moved in relation to the ladder. Furthermore, the support devices used to hang the tray are located above the tray container and often block access to the container portion of the tray. Tray supports of this type often do not have a secure attachment to the tray, as well, and allow the tray to swing in relation to the support if the support is used to carry the tray up or down the ladder.

An additional problem with existing ladder supporting trays is the instability of the holding tray when the trays are not in attachment to a ladder. Filling a tray with paint or other items is difficult as the user must somehow support the tray to do so. Use of a tray of this type when off the ladder is extremely restricted and often not even possible.

Still another problem with existing ladder supported holding trays is the absence of a suitable handle. Many trays do not have a handle and require the user to grab on to the tray wherever possible. This is problematic to the user who is required to both hold the tray while moving up and down the ladder, and to hold the tray while securing the tray to the ladder. Not finding an adequate area to hold on to the tray can be both difficult and dangerous to the user while moving the tray or securing it to the ladder.

Tray designs that do utilize a handle have problems associated with the use of the handle. Many handles also additionally serve as the support from which the tray hands. In this design the handle is typically located above the tray and often obstructing the user from the tray itself. Furthermore, the tray is allowed to swing from a handle of this type which is typically non-fixed and pivots freely about the tray. The user in this case has to carefully keep the tray from swinging and losing the contents of the tray. Additionally, the user of a tray of this type has to mount the handle onto a step or rung and then somehow remove his or her hand from the handle once the handle is attached to the ladder.

Other tray designs that also include a handle make the handle only useful when moving up or down the ladder. The handle in these tray designs is often unusable during the mounting of the tray on the ladder. This requires the user to hold onto a different portion of the tray during securement of the tray to the ladder, a process which is both difficult and dangerous when standing atop a ladder.

Because of the aforementioned reasons there is a need for a ladder supported holding tray that: securely and easily mounts and dismounts to different types of ladders; will securely mount to a single step of a step ladder or to adjacent side by side rungs of overlapping sections of an extension ladder; allows the user to mount the tray with one hand only and includes no fasteners; includes no support member that will obstruct the user from accessing the container portion of the tray; is self supporting when the tray is not attached to a ladder; and, provides a secure handle for easily holding the tray while moving the tray, or while securing the tray to a ladder, which does not interfere with utilizing the tray once mounted to a ladder.

SUMMARY

The tray assembly of the present invention satisfies all of the aforementioned needs for a ladder supported holding tray.

The ladder supported holding tray of the present invention comprises a tray assembly for releasable attachment to a step of a step ladder, or to adjacent side by side rungs of overlapping sections of an extension ladder. The tray assembly includes a container including at least first and second ends and a bottom panel joined together to define a hollow interior receptacle having a front and a back edge. The tray assembly further includes first and second supports disposed on the container, with the first and second supports being substantially disposed beneath the container and supporting the container in an elevated position relative to the supports. The tray assembly additionally includes step engagement means. The step engagement means may typically be disposed on the first and second supports to permit secure temporary attachment of the tray to a single step of a step ladder without the tray assembly engaging the side rail members of the ladder or other steps or rungs of the ladder.

The tray assembly of the present invention typically positions the container substantially above the step to which it is engaged and positions the supports substantially below that step. The supports of the tray assembly are typically at first and second ends of the container and each support may include two opposing step engagement means. The step engagement means typically comprise an upward sloping concave surface configured to releasably engage and securely hook onto a step from underneath the step. The step engagement means typically originate on each support proximate to the center of the container and extend therefrom to a position proximate an edge of the container. Additionally, the step engagement means are typically separated from the container bottom by a step receiving recess defined by the gap between the container bottom and the upward sloping surface of the step engagement means, with the gap being slightly larger than the thickness of a step which is received into the recess for securely positioning the tray on that step.

The tray may typically include a handle on the container bottom with the handle typically being a fixed non-pivoting type. The handle is typically disposed in a vertical orientation on the container bottom proximate to the center of the container and intermediate the first and second supports. The handle further typically comprises a first and second end attached to the container bottom and a hand grip portion intermediate the first and second ends.

The ladder supported tray assembly of the present invention includes new features providing benefits heretofore unrealized by prior art tray designs. A first benefit of the tray assembly of the present invention is the ability of the tray to be easily mounted to a single step of a step ladder or to adjacent side by side rungs of overlapping sections of an extension ladder. The user of the tray assembly needs only to choose which step or rungs to support the tray and then to slide the tray assembly onto that step or rungs. The tray assembly requires no fasteners or the manipulation of adjustable supports to mount it securely. The procedure for mounting the tray is extremely easy and requires just one hand allowing the user to maintain balance on the ladder by maintaining contact with the ladder with the other hand. The process for mounting the tray assembly to a ladder only requires a slight tilting of the tray to slide the step or rungs into the recess separating the step engagement means and the container bottom. Once the tray container is above the step or rungs the tray is securely mounted to the ladder.

The step engagement means include an upward sloping surface that is typically concave that allows the tray assembly to lock itself to the step or rungs to which it is engaged. Once engaged the upward sloping surface of the step engagement means prevent a lateral force from moving the tray in relation to the ladder. The tray assembly in mounting the container on top of a step or set of rungs while at the same time securing the tray with step engagement means that are beneath the step or set of rung is resistant to upward or downward forces, as well. Nevertheless, the tray assembly is easily removed from a step or set of rungs. The user must only tilt the tray to release the tray from the step while moving the tray assembly away from the ladder.

The tray assembly of the present invention includes the additional benefit of including no structural elements or support members that would interfere with access to the container portion of the tray in use. The entire supporting structure of the tray assembly is located beneath the container and therefore no elements of the tray are adjacent to the container top. The supporting members also provide a suitable structure for supporting the tray on a flat surface if the user desires to use the tray assembly away from a ladder.

A further benefit of the tray assembly of the present invention is the provision of a handle attached to the container bottom. The handle provides a secure attachment point for the user, and allows the user to easily move with the tray up and down a ladder. The handle located along the container bottom does not obstruct the container top as many handles do. The handle which is fixed and non-pivoting does not permit the tray to swing and possibly spill the contents from the container during movement. The handle is further located close to the center of gravity of the entire tray assembly. This attachment location causes the entire tray assembly to be easily moved without the user having to resist the weight of the tray and its contents. The handle is also mounted on the container bottom in such a way that it does not interfere with mounting the tray to a step or removing the tray from a step. The ladder supported holding tray requires a minimum of materials to manufacture, and is durable in construction.

These and other advantages of the present invention will become apparent upon inspection of the accompanying specification, claims and drawings.

DRAWINGS

DESCRIPTION

Figure 1:
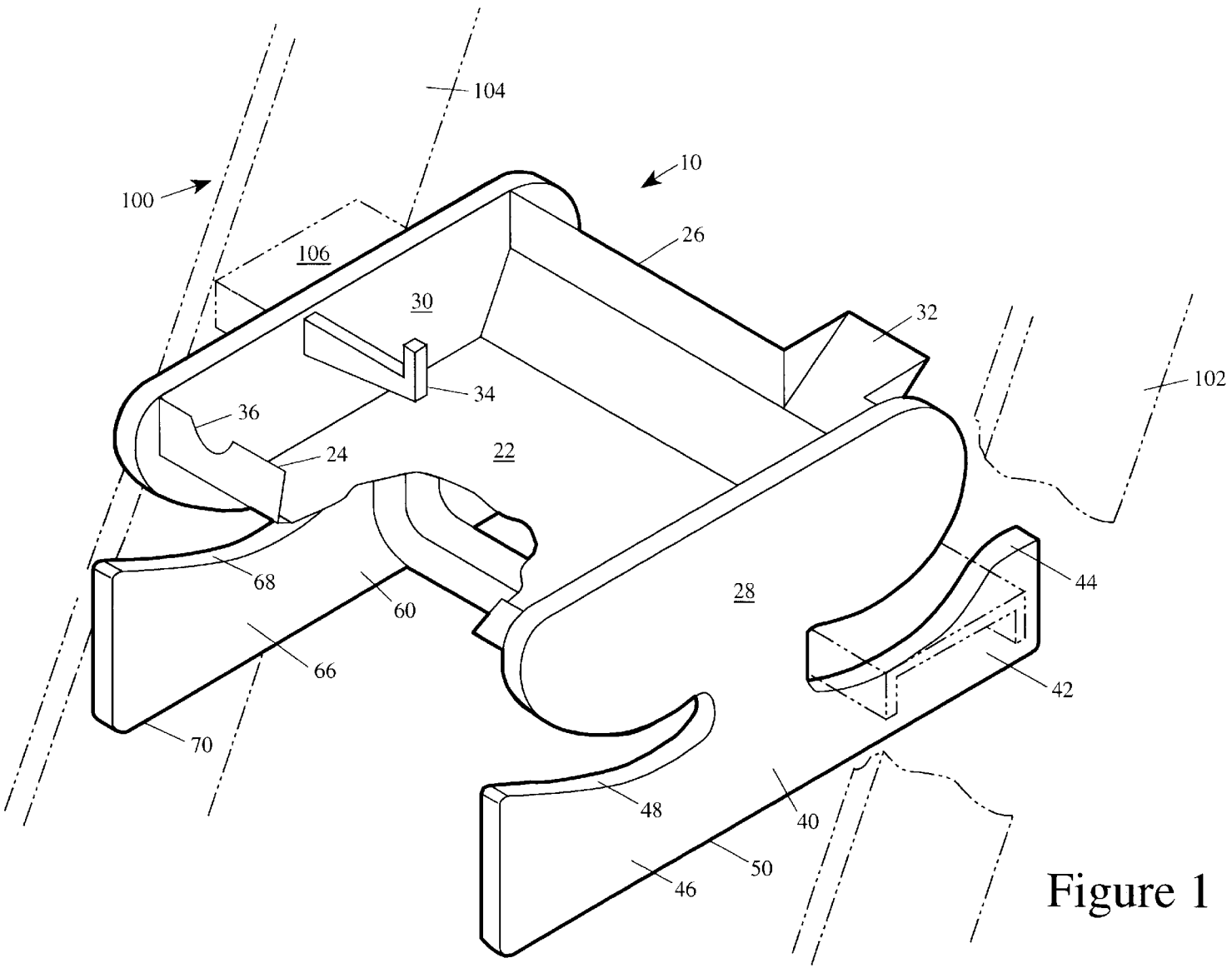
FIG. 1 is a perspective view of a version of the ladder supported holding tray of the present invention attached to a wooden step ladder.
Figure 2:
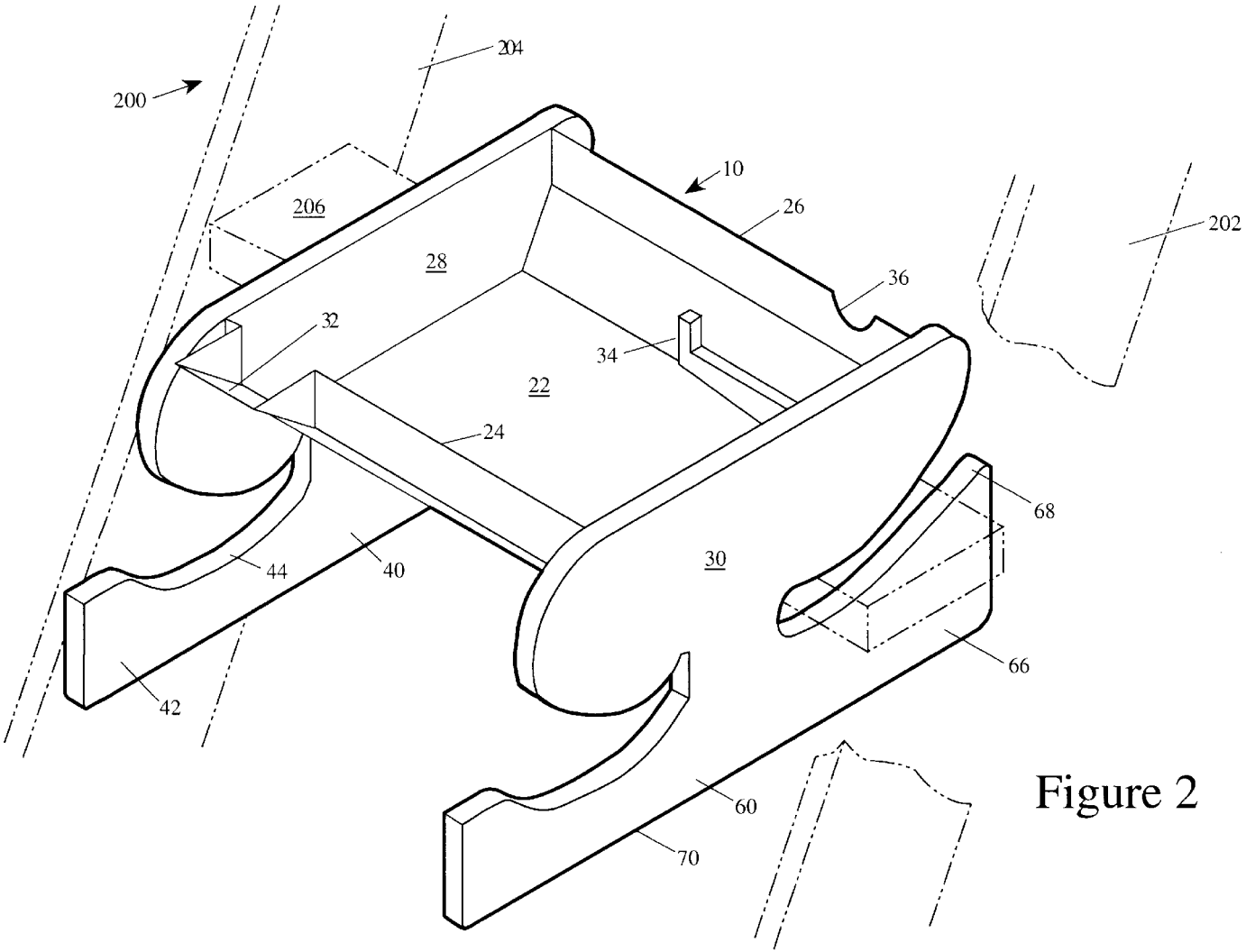
FIG. 2 is a perspective view of a version of the ladder supported holding tray of the present invention attached to a step ladder having metal steps.
Figure 3:
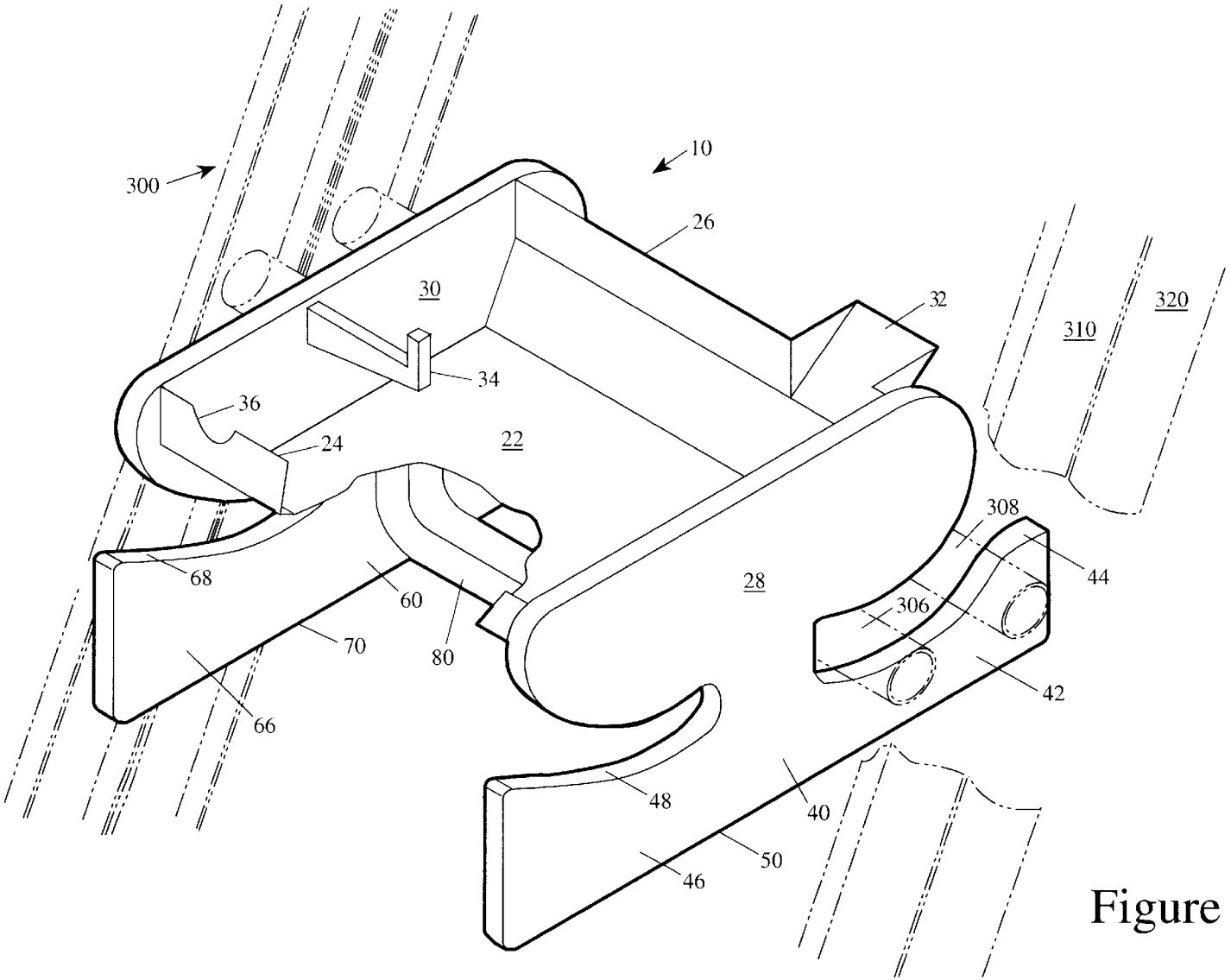
FIG. 3 is a perspective view of a version of the ladder supported holding tray of the present invention attached to an adjacent side by side rungs of overlapping sections of an extension ladder.
Figure 4:
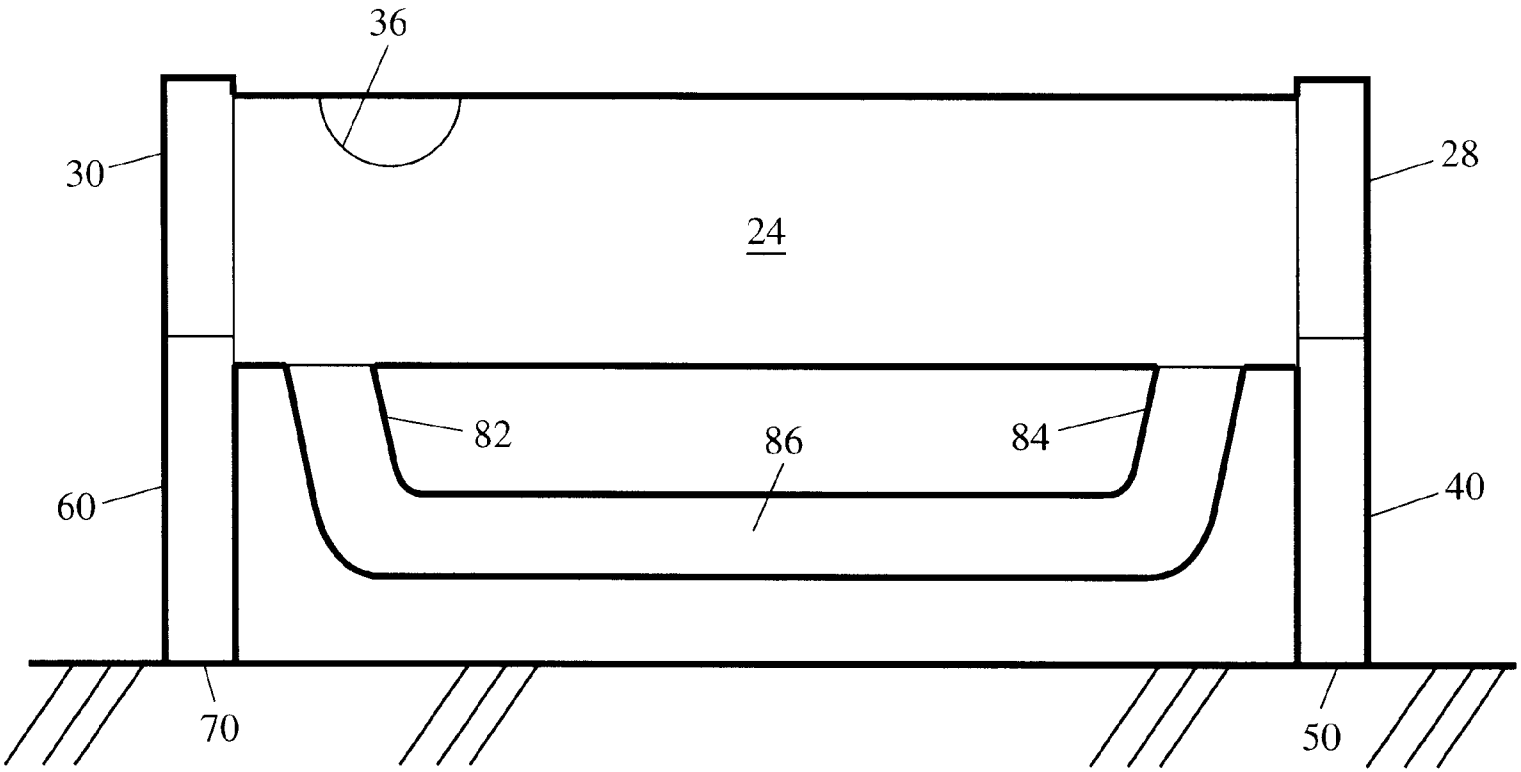
FIG. 4 is a front elevation of a version of the ladder supported holding tray of the present invention supported on a flat surface.

Referring in more detail to the drawings, there is illustrated in FIGS. 1 to 3 the releasable attachment of a preferred version of the ladder supported holding tray of the present invention to three types of ladders currently available on the market. FIG. 1 shows the ladder supported holding tray attached to a step ladder having a deep section metal step. FIG. 2 shows the ladder supported holding tray attached to a step ladder having a wooden metal step. And, FIG. 3 shows the ladder supported holding tray attached to two adjacent side by side rungs of overlapping sections of an extension ladder. FIG. 4 shows an elevation view of the ladder supported holding tray supported on a flat surface and showing the attachment of the handle to the container of the tray.

In greater detail, FIG. 1 shows a version of the ladder supported holding tray 10 comprising a container shown generally at 20 which includes a bottom panel 22, a first end panel 24, and a second end panel 26, a first side panel 28 and a second side panel 30. FIG. 1 additionally shows a version of the present invention that includes a spout 32 disposed on the second end panel 26, and a brush holder 34 disposed on second side panel 30. Typically included with the brush holder 34 would be a brush handle recess 36 as is shown in the version of the present invention of FIG. 1.

Integral with side panel 28 is first support 40 which includes first step engagement means 42 and second step engagement means 46. First step engagement means 42 includes a concave upward sloping surface 44 and second step engagement means 46 includes a similar concave upward sloping surface 48. A step receiving recess separates the concave upward sloping surfaces 44 and 48 from the bottom of the container 20.

Step engagement means 42 is shown in FIG. 1 engaging a deep section metal step 106 of step ladder 100. As shown in FIG. 1, ladder 100 additionally includes side rail members 102 and 104. Hidden from view in FIG. 1 is the first step engagement means of the second support 60 which is also engaged to step 106. As is further shown in FIG. 1, step 106 is disposed within the step receiving recess separating the concave upward sloping surface 44 from container 20. Concave upward sloping surface 44 engages the bottom of step 106. The step 106 is similarly engaged by the first step engagement means of the second support 60, also hidden from view. The first step engagement means of the first and second supports comprise a first set of engagement means.

First and second supports 40 and 60 each typically have a flat bottom surface 50 and 70 respectively. The flat bottom surface 50 and 70 allow the ladder supported holding tray 10 to be stable if supported on a flat surface. First support 40 additionally includes a second step engagement means 46. The second step engagement means 46 of first support 40 also includes a concave upward sloping surface 48. This concave upward sloping surface 48 is separated by a step receiving recess from the container 20. Second support 60 also includes a second step engagement means 66. This second step engagement means 66 also includes a concave upward sloping surface 68, which is also separated from the container 20 by a step receiving recess.

The second step engagement means 46 of the first support 40 with the second step engagement means 66 of the second support 60 comprise a second set of step engagement means. In the version of the present invention of FIG. 1, the second set of step engagement means include a smaller step receiving recesses than those of the first set of step receiving recesses that in FIG. 1 have step 106 disposed within them. Additionally shown in the version of the invention as shown in FIG. 1, is a handle 80 disposed on the bottom panel 22 of container 20 which has been partially cut away in this figure to show the handle.

FIG. 2 shows the ladder supported holding tray of the present invention disposed on a step ladder having a wooden step. In this figure, the ladder supported holding tray is identical to the tray of FIG. 1, however, the second set of step engagement means is engaged to a wooden step 206. In this diagram, step 206 is disposed in the small recess separating the concave upward sloping surface 68 of the second step engagement means 66 of the second support 60 from the container 20. The step is similarly engaged by the second step engagement means of the first support, also hidden from view in this figure.

FIG. 3 shows the ladder supported holding tray of the present invention disposed on an extension ladder 300 having adjacent side by side rungs 306 and 308 of overlapping sections 310 and 320 of the extension ladder. In this figure, the ladder supported holding tray is also identical to the tray of FIG. 1, however, the first step engagement means 42 is engaged to the adjacent side by side rungs 306 and 308 of the overlapping sections 31 0 and 320 of the extension ladder 300. In this diagram rungs 306 and 308 are both disposed in the large recess separating the concave upward sloping surface 44 from the container 20. The rungs 306 and 308 are similarly engaged by the step engagement means of the second support, also hidden from view in this figure.

FIG. 4 is a front elevation view of the version of the present invention of FIG. 1, showing the handle 80 in greater detail. Handle 80 includes first and second ends 82 and 84, both of which are attached to the bottom panel 22 of container 20. Intermediate the first and second ends is hand grip portion 86. The handle 80 is disposed on the ladder supported holding tray very close to the center of gravity of the entire tray and thus provides very stable maneuvering of the tray. The handle 80 is typically a fixed, non-pivoting attachment to the container portion of the tray 10, which adds to the stable maneuvering of the tray. FIG. 4 further shows the stability of the tray when resting on the bottom surfaces 50 and 70 of the first and second supports 40 and 60.

Using the ladder supported holding tray 10 of the present invention is simple. If desired, the container 20 of the tray 10 and be easily filled with paint, hardware, etc., before attachment of the tray to a ladder. The first and second supports 40 and 60 allows the user to rest the tray 10 on any flat surface. The tray 10 does not require any extra support when filling the container 20 with paint or hardware at is very stable when supported on a flat surface. Once filled, the user must determine which set of step engagement means provided on the tray will provide the tightest fit to the step or set of rungs. Thereafter, the user can easily lift the tray 10 using the handle 80 and proceed up a ladder. The handle provides the user a very stable connection to the tray and does not obstruct access to the container 20.

Once the user has determined the step or set of rungs from which to support the tray, the user needs only to slide the tray onto that step or set of rungs. To slide the tray 10 onto a step or set of rungs, the user needs only to slightly tilt the tray slightly so that the leading edge of the set of step engagement means will pass under the step. At the same time, the user moves the tray toward the step until the step is as far into the step receiving recesses as is possible. At this point, the tray is securely engaged to the step and the user can release the handle. At no time during the mounting of the tray to the step does the user have to reposition his or her hand on the handle. Additionally, the other hand of the user is not required for mounting the tray, so the user can maintain a firm hand hold on the ladder.

Releasing the tray from the step or set of rungs is as easy as securing the tray to a step or set of rungs. The user needs only to grab the handle and then pull the tray away from the ladder while slightly tilting the tray forward to release the step engagement means from the step or set of rungs.

Once secured to a step or set of rungs the tray is extremely stable. The tray is essentially locked on to the step or set or rungs and resists all movement in relation to the step or set or rungs. There is little chance of accidentally knocking the tray off the ladder as releasing the tray from the step or set of rungs requires the tray to be simultaneously tilted slightly and moved away from the ladder. The tray also resists side to side movement well and resists upward or downward movement as the container portion of the tray rides above the step while the step engagement means rides below the step. Filling the tray with paint or supplies once the tray is secured to a ladder is easy due to the stability of the tray attachment to the ladder. The ladder supported holding tray 10 is typically manufactured to be narrower than the typical ladder so that there is plenty of hand room between the side panels of the tray and the side rails of the ladder.

The ladder supported holding tray is easily manufactured using existing plastic molding techniques. The tray could be produced as a single piece or as multiple pieces that require a small degree of assembly. The tray container could be manufactured in a variety of sizes or shapes. The container could also be built for a specific purpose such as to accommodate a paint roller or certain plumbing or electrical fittings.

It is understood that various modifications and changes in form or detail could readily be made without departing from the spirit of the invention. It is therefore intended that the invention be not limited to the exact form and detail herein shown and describe, nor to anything less than the whole of the invention herein disclosed and as hereinafter claimed.

We claim:

1. In combination, a step ladder and a tray for releasable attachment to the step ladder comprising:

a step ladder including opposing side rails, a ladder top disposed between the opposing side rails, and a plurality of steps disposed between the opposing side rails, underneath the ladder top; wherein each step includes a flat top surface having a front and back edge, a front side comprising a surface attached to the flat top front edge and extending downwardly therefrom, a back side comprising a surface attached to the flat top back edge and extending downwardly therefrom, and wherein the front side and the back side each include a bottom edge; and wherein each step includes a width defined by the distance from the front surface to the back surface; and, wherein the area between the front side and the back side of each step is disposed in front of the back side of the step;

a tray attached to a selected step of the step ladder, the tray comprising:

at least one step engagement means disposed on the tray to permit secure temporary attachment of the tray to the ladder through secure temporary engagement to a single selected step of the step ladder; wherein the step engagement means alone are sufficient to provide secure temporary attachment of the tray to the step ladder; and wherein no additional engagement of the tray to the ladder, other than the step engagement means is needed for attachment;

wherein the step engagement means includes an upward sloping surface to releasably engage and securely hook onto the selected step from a position underneath the selected step;

wherein the step engagement means extends under the entire width of the step from a first position beneath the front side of the step proximate to where the step engagement means is attached to the tray; to a second position beneath the back side of the step where the step engagement means is separated from the tray by a step receiving recess, and, wherein the step engagement means is further attached to the tray only through the attachment proximate to the first position; and wherein the length of the step engagement means is larger than the entire width of the step; wherein the step engagement means extends past the second position beneath the back side of the step to a distal end which does not contact the top of the step; and, wherein the upward sloping surface slopes upwardly in relation to the flat top of the selected step;

wherein the upward sloping surface begins at a location in front of the bottom edge of the back side of the step and wherein the upward sloping surface engages the bottom of the back side of the step.

2. The combination of claim 1, wherein the tray comprises a container including at least first and second ends and a bottom panel joined together to define a hollow interior receptacle having a front and a back edge; and wherein the container additionally comprises first and second side panels;

wherein a first support is disposed on the first side panel and a second support is disposed on the second side panel, and at least one step engagement means is disposed on each support.

3. The combination of claim 2, wherein the supports are disposed on the container side panels and extends therefrom to a position substantially beneath the container, and wherein the tray once engaged to the selected step positions the container substantially above that step and additionally positions the supports substantially below that step.

4. The combination of claim 2, wherein the first and second supports each include two opposing step engagement means, one substantially beneath one end of the container and one substantially beneath the other end of the container; wherein each of the step engagement means originate at a position on each support proximate to the center of the container and extend therefrom to a position proximate an end of the container.

5. The combination of claim 2, additionally including a handle disposed on the container bottom panel intermediate the first and second supports.

6. The tray assembly of claim 1, wherein the upward sloping surface is also concave.

7. In combination, an extension ladder having multiple sections and a tray for releasable attachment to the extension ladder comprising:

an extension ladder having at least front and back sections; and wherein at least a portion of the front and back sections are in an overlapping orientation; each ladder section including opposing side rails and a plurality of substantially round rungs disposed between the opposing side rails; wherein each rung includes a top for foot support, a bottom, a front and a back; wherein the overlapping front and back sections of the ladder include a plurality of adjacent side by side pairs of front and back rungs, and wherein each pair of adjacent side by side rungs defines a single step having a width defined by the distance from the front of the front rung to the back of the back rung;

a tray attached to the extension ladder, the tray comprising:

at least one step engagement means disposed on the tray to permit secure temporary attachment of the tray to the ladder through secure temporary engagement to a single selected step of the extension ladder; wherein the step engagement means alone are sufficient to provide secure temporary attachment of the tray to the extension ladder; and wherein no additional engagement of the tray to the ladder, other than the step engagement means, is needed for attachment;

wherein the step engagement means includes an upward sloping surface to releasably engage and securely hook onto the selected step from a position underneath the selected step;

wherein the step engagement means extends under the entire width of the step from a first position beneath the front of the front rung proximate to where the step engagement means is attached to the tray; to a second position beneath the back of the back rung where the step engagement means is separated from the tray by a step receiving recess; and, wherein the step engagement means is further attached to the tray only through the attachment proximate to the first position; and wherein the length of the step engagement means is larger than the entire width of the step; and wherein the upward sloping surface slopes upwardly in relation to a plane connecting the tops of the front and back rungs of the selected step; and, wherein the upward sloping surface begins at a location in front of the bottom of the back rung, and wherein the upward sloping surface engages the bottom of the back rung.

8. The combination of claim 7, wherein the tray comprises a container including at least first and second ends and a bottom panel joined together to define a hollow interior receptacle having a front and a back edge; and wherein the container additionally comprises first and second side panels;

wherein a first support is disposed on the first side panel and a second support is disposed on the second side panel, and at least one step engagement means is disposed on each support.

9. The combination of claim 8, wherein the supports are disposed on the container side panels and extends therefrom to a position substantially beneath the container, and wherein the tray once engaged to the selected step positions the container substantially above that step and additionally positions the supports substantially below that step.

10. The combination of claim 8, wherein the first and second supports each include two opposing step engagement means, one substantially beneath one end of the container and one substantially beneath the other end of the container; wherein the step engagement means originate at a position on each support proximate to the center of the container and extend therefrom to a position proximate an end of the container.

11. The combination of claim 8, additionally including a handle disposed on the container bottom panel intermediate the first and second supports.

12. The tray assembly of claim 7, wherein the upward sloping surface is also concave.

* * * * *